US012247176B2

(12) United States Patent
Burette et al.

(10) Patent No.: US 12,247,176 B2
(45) Date of Patent: Mar. 11, 2025

(54) USE OF HYDROGENATED DIENE STYRENE POLYMER TO REDUCE PARTICULATE EMISSIONS

(71) Applicant: TotalEnergies OneTech, Courbevoie (FR)

(72) Inventors: Gautier Burette, Solaize (FR); François Paoloni, Solaize (FR)

(73) Assignee: TotalEnergies OneTech, Courbevoie (FR)

( * ) Notice: Subject to any disclaimer, the term of this patent is extended or adjusted under 35 U.S.C. 154(b) by 0 days.

(21) Appl. No.: 17/913,607

(22) PCT Filed: Mar. 23, 2021

(86) PCT No.: PCT/EP2021/057439
§ 371 (c)(1),
(2) Date: Sep. 22, 2022

(87) PCT Pub. No.: WO2021/191210
PCT Pub. Date: Sep. 30, 2021

(65) Prior Publication Data

US 2023/0141132 A1 May 11, 2023

(30) Foreign Application Priority Data

Mar. 25, 2020 (FR) ..... 2002902

(51) Int. Cl.

| | |
|---|---|
| ***C10M 143/12*** | (2006.01) |
| ***C10M 143/10*** | (2006.01) |
| ***C10M 169/04*** | (2006.01) |
| *C10N 20/00* | (2006.01) |
| *C10N 20/06* | (2006.01) |
| *C10N 30/00* | (2006.01) |
| *C10N 40/25* | (2006.01) |
| *C10N 60/02* | (2006.01) |

(52) U.S. Cl.
CPC ..... *C10M 143/12* (2013.01); *C10M 143/10* (2013.01); *C10M 169/041* (2013.01); *C10M 2205/04* (2013.01); *C10M 2205/06* (2013.01); *C10N 2020/06* (2013.01); *C10N 2020/073* (2020.05); *C10N 2030/50* (2020.05); *C10N 2030/54* (2020.05); *C10N 2040/25* (2013.01); *C10N 2060/02* (2013.01)

(58) Field of Classification Search
CPC ..... C10M 143/12; C10M 143/10; C10M 169/041; C10M 2205/04; C10M 2205/06; C10N 2020/06; C10N 2020/073; C10N 2030/50; C10N 2030/54; C10N 2040/25; C10N 2060/02
USPC ..... 508/591
See application file for complete search history.

(56) References Cited

U.S. PATENT DOCUMENTS

| | | | | |
|---|---|---|---|---|
| 2005/0003974 | A1* | 1/2005 | Briggs | C10M 143/12 508/591 |
| 2007/0099802 | A1* | 5/2007 | Scott | C10M 167/00 508/460 |
| 2010/0256030 | A1* | 10/2010 | Hartley | C10M 165/00 508/525 |
| 2012/0101017 | A1* | 4/2012 | Duggal | C10M 143/10 508/591 |
| 2012/0157364 | A1* | 6/2012 | Kelley | C10M 157/00 508/591 |
| 2013/0165362 | A1* | 6/2013 | Oberoi | C08F 8/04 508/591 |
| 2014/0005088 | A1* | 1/2014 | Doan | C10M 143/12 508/591 |
| 2014/0162924 | A1* | 6/2014 | Watts | C10M 143/12 508/591 |
| 2014/0287970 | A1* | 9/2014 | Smythe | C10M 169/04 508/525 |
| 2015/0184105 | A1* | 7/2015 | Taribagil | C10M 107/14 508/591 |
| 2015/0184108 | A1* | 7/2015 | Taribagil | C10M 169/041 508/591 |
| 2016/0083669 | A1* | 3/2016 | Yoshida | C10M 143/12 508/591 |
| 2020/0040276 | A1* | 2/2020 | Amblard | C10M 141/10 |
| 2021/0171854 | A1* | 6/2021 | Gavand | C10M 143/12 |

FOREIGN PATENT DOCUMENTS

| | | | | |
|---|---|---|---|---|
| EP | 2363454 | A1 * | 9/2011 | C10M 169/041 |
| WO | 2018/065606 | A1 | 4/2018 | |
| WO | 2019/202150 | A1 | 10/2019 | |

OTHER PUBLICATIONS

Rapport de Recherche Préliminaire issued in European Patent Application No. 2002902 dated Jul. 17, 2020.
Rapport de Recherche Internationale issued in International Patent Application No. PCT/EP2021/057439 dated Jun. 30, 2021.

* cited by examiner

*Primary Examiner* — Ellen M McAvoy
(74) *Attorney, Agent, or Firm* — Troutman Pepper Locke LLP

(57) ABSTRACT

The present application relates to the use of a lubricant composition comprising a base oil and a hydrogenated diene styrene polymer to reduce engine particulate emissions.

9 Claims, No Drawings

USE OF HYDROGENATED DIENE STYRENE POLYMER TO REDUCE PARTICULATE EMISSIONS

CROSS REFERENCE TO RELATED APPLICATIONS

The present application is a U.S. National Phase Application under 35 U.S.C. § 371 of International Patent Application No. PCT/EP2021/057439 filed Mar. 23, 2021, which claims priority of French Patent Application No. 20 02902 filed Mar. 25, 2020. The entire contents of which are hereby incorporated by reference.

FIELD OF INVENTION

The present invention relates to the use of hydrogenated styrene diene polymer for reducing particle emissions from motor vehicles.

BACKGROUND

The first European standard on emissions from vehicles with combustion engines was introduced in 1992. Coming into force on 1 Sep. 2014 for newly approved vehicles and applicable to all new vehicles from 1 Sep. 2015, the Euro 6 emission standard (EC standard 715/2007, amendment 692/2008) relates to both gasoline and diesel engines. This standard in particular concerns four pollutants: carbon monoxide (CO), unburned hydrocarbons (HC), nitrogen oxides (NOx), weight (PM) and number (PN) of particles, amongst which soot, the last two remaining the most problematic for the pollution control system of modern engines.

Going after $CO_2$ prompted manufacturers to increase the efficiency thereof so as to lower the consumption of $CO_2$. To this end, often was chosen a for lean-burn operation (air in excess compared to the weight of fuel). Unfortunately, such a process generates a significant increase in the emissions of nitrogen oxide and particles.

In the past, manufacturers have also chosen to introduce particle filter systems for reducing the number and weight of particles emitted into the atmosphere. In most cases, the operation of such systems consists of the combustion of soot due to the temperature rise of the exhaust gases at the inlet of the filter. Such operation requires the presence of catalysis.

Further finding additives for lubricating compositions and lubricating compositions with direct impact on the emission of particles, would be an advantage.

SUMMARY

A goal of the present invention is thus to provide an additive for a lubricating composition with direct impact on particle emissions.

Another goal of the present invention is to provide a lubricating composition with direct impact on particle emissions.

Further goals will emerge upon reading the following description of the invention.

Such goals are fulfilled by the present application which relates to the use of a lubricating composition comprising a base oil and at least one hydrogenated diene styrene polymer, for reducing particle emissions from an engine.

In the context of the present invention, the term "particles" refers to the particles emitted by the exhaust of motor vehicles. It means a family of microscopic particles (about μm or less in size). Such substances are varied and are comprised in the vehicle exhaust gases coming from the combustion of fuel. Such substances can be either solid or liquid. The term particles comprises the term soot, which is formed, is oxidized and contains unburned hydrocarbons, oxygenated derivatives (ketones, esters, aldehydes, lactones, ethers, organic acids) and polycyclic aromatic hydrocarbons (the famous PAHs) along with the nitrated, oxygenated derivatives thereof, etc. Furthermore, there are also mineral (SO2, sulphates, etc.) and metal derivatives.

In a particularly advantageous manner, the present invention can be used for reducing the emissions of particles with a size greater than or equal to 23 nm.

Within the framework of the present invention, the term "particle size" refers to particles, or agglomerate of particles the size of which is comprised between 23 and 100 nm, preferentially between 23 and 60 nm, and more preferentially between 23 and 40 nm.

The particle size can be measured by spectrometry, e.g. using a spectrometer manufactured by Cambustion under the commercial reference DMS500.

Reduction of particle emissions refers, in particular, to the reduction of the number of particles, in particular of particles having a size greater than or equal to 23 nm. Reducing the number of particles emitted during a WLTC cycle is discussed, in particular. The reduction is mainly determined as a function of the number of kilometers traveled.

The number of particles can in particular be measured by a particle counter device such as the device existing under the commercial reference AVL APC 489.

Preferentially, the present application relates to the reduction of soot emissions.

Preferentially, the present invention relates to the reduction of the emissions of particles, preferentially particles of size greater than or equal to 23 nm, preferentially soot, during the urban (low speed), peri-urban (moderate speed) and road (high speed) cycles defined by the WLTC (or WLTP) (Worldwide Harmonized Light vehicle Test Procedure) and across all WLTC.

The hydrogenated diene styrene polymer (or hydrogenated styrene/isoprene polymer) according to the invention is a hydrogenated copolymer of styrene and diene. Same is one of the compounds classified amongst the additives which improve the viscosity index.

The hydrogenated styrene/diene copolymer according to the invention can be chosen from either linear or star-shaped copolymers, preferentially star-shaped copolymers.

The hydrogenated styrene/diene copolymer can be chosen from block copolymers or statistical copolymers.

Preferentially, the content of hydrogenated diene units is from 50 to 98%, preferentially from 60 to 98%, more preferentially from 70 to 97%, even more preferentially from 75 to 96% by weight, with respect to the weight of the copolymer.

Preferentially, the content of styrene units is from 2 to 50%, preferentially from 2 to 40%, more preferentially from 3 to 30%, even more preferentially from 4 to 25% by weight, with respect to the weight of the copolymer.

In one embodiment, the hydrogenated styrene/diene copolymer according to the invention has a weight-average molecular weight Mw ranging from 100,000 to 800,000 Da, preferentially from 200,000 to 700,000 Da, more preferentially from 300,000 to 600,000 Da, even more preferentially from 400,000 to 500,000 Da.

In one embodiment of the invention, the hydrogenated styrene/diene copolymer according to the invention has a number-average molecular weight Mn ranging from 50,000 to 800,000 Da, preferentially from 75,000 to 600,000 Da, more preferentially from 100,000 to 500,000 Da, even more preferentially from 100,000 to 200,000 Da.

The measurement of the number- and weight-average molecular weights (Mn and Mw) is performed by gel permeation chromatography (GPC).

In one embodiment of the invention, the hydrogenated styrene/diene copolymer according to the invention has a dispersity index ranging from 1 to 4, preferentially from 1.2 to 3.5, more preferentially from 1.5 to 3.5, even more preferentially from 2 to 3.

Preferentially, the hydrogenated styrene diene copolymer is used in an amount of 0.1 to 15% by weight with respect to the total weight of the lubricating composition.

The amount is understood as the amount of active polymer material (dry extract). Indeed, the hydrogenated copolymer of styrene and diene used in the context of the present invention can be in the form of a dispersion in a mineral or a synthetic oil, and more particularly in a group III oil according to the API classification.

Preferentially, the hydrogenated diene unit is a hydrogenated butadiene unit or hydrogenated isoprene unit, which is then referred to as a hydrogenated styrene/butadiene polymer or a hydrogenated styrene/isoprene polymer.

Preferentially, the hydrogenated diene unit is a hydrogenated isoprene unit, which is then referred to as a hydrogenated styrene/isoprene polymer.

The base oil used in the lubricating compositions of the invention can be oils of mineral or synthetic origin belonging to groups I to V according to the classes defined by the API classification (or the equivalents thereof according to the ATIEL classification (Table 1) or the mixtures thereof.

TABLE 1

| | Concentration of saturated substances | Sulfur concentration | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydro-isomerized oils | ≥90% | ≤0.03% | ≥120 |
| Group IV | Polyalphaolefines (PAO) | | |
| Group V | Esters and other bases not included in groups I to IV | | |

The mineral base oils of the invention include any type of base oil obtained by atmospheric distillation and vacuum distillation of crude oil, followed by refining operations such as solvent extraction, deasphalting, solvent dewaxing, hydrotreatment, hydrocracking, hydroisomerization and hydrofinishing.

Mixtures of synthetic and mineral oils can be further used.

The base oils of the lubricating compositions according to the invention can be further chosen from synthetic oils, such as certain esters of carboxylic acids and alcohols, and polyalphaolefins. The polyalphaolefins used as base oil are e.g. obtained from monomers comprising from 4 to 32 carbon atoms, e.g. from octene or decene, and for which the viscosity at 100° C. is comprised between 1.5 and 15 mm2.s-1 as per the ASTM D445 standard. The mean molar weight thereof is generally comprised between 250 and 3,000 as per the standard ASTM D5296.

The lubricating composition according to the invention can comprise at least 50% by weight of base oil with respect to the total weight of the composition. More advantageously, the lubricating composition according to the invention comprises at least 60% by weight, or even at least 70% by weight, of base oils with respect to the total weight of the lubricating composition. More preferentially, the lubricating composition according to the invention comprises from 75 to 97% by weight of base oils with respect to the total weight of the composition.

The composition of the invention can further comprise at least one additive.

Many additives can be used in the lubricating compositions according to the invention.

The preferred additives for the lubricating composition according to the invention are chosen from detergent additives, friction modifying additives different from the molybdenum compounds defined above, extreme pressure additives, dispersants, pour-point activators, antifoaming agents, thickeners and mixtures thereof.

Preferentially, the lubricating compositions according to the invention comprise at least one extreme pressure additive, or a mixture.

Anti-wear additives and extreme pressure additives protect against surface friction by forming a protective film adsorbed on the surfaces.

There is a wide variety of anti-wear additives. Preferentially, for the lubricating compositions of the invention, the anti-wear additives are chosen from additives comprising phosphorus and sulfur, such as metal alkylthiophosphates, in particular zinc alkylthiophosphate, and more precisely zinc dialkyldithiophosphate or ZnDTP. Preferred compounds have the formula Zn((SP(S)(OR)(OR'))2, wherein R and R'—either identical or different—independently represents an alkyl group, preferentially an alkyl group comprising from 1 to 18 carbon atoms.

Amine phosphates are also anti-wear additives which can be used in the lubricating compositions of the invention. However, the phosphorus atoms provided by such additives can act as a poison in the catalytic systems of automobiles since same generate ash. Such effects can be minimized by substituting part of the amine phosphates with non-phosphorus additives, such as polysulfides, in particular sulfur-containing olefins.

Advantageously, the lubricating compositions according to the invention can comprise from 0.01 to 6% by weight, preferentially from 0.05 to 4% by weight, more preferentially from 0.1 to 2% by weight with respect to the total weight of lubricating composition, anti-wear additives and extreme pressure additives.

Advantageously, the lubricating compositions according to the invention comprise from 0.01 to 6% by weight, preferentially from 0.05 to 4% by weight, more preferentially from 0.1 to 2% by weight with respect to the total weight of lubricating composition, of anti-wear additives (or anti-wear compound).

Advantageously, the compositions according to the invention can comprise at least one friction modifying additive different from the molybdenum compounds of the invention. The friction modifying additives can in particular be chosen from compounds providing metallic elements and ashless compounds. Compounds providing metal elements include complexes of transition metals such as Mo, Sb, Sn, Fe, Cu, Zn for which the ligands can be hydrocarbon compounds comprising oxygen, nitrogen, sulfur or phosphorus atoms. Ashless friction modifying additives are generally of organic origin or can be chosen from fatty acid and polyol monoesters, alkoxylated amines, alkoxylated fatty amines, fatty epoxides, fatty epoxide borates, fatty amines or glycerol acid esters. According to the invention, fatty compounds comprise at least one hydrocarbon group comprising from 10 to 24 carbon atoms.

Advantageously, the lubricating composition according to the invention can comprise from 0.01 to 2% by weight or from 0.01 to 5% by weight, preferentially from 0.1 to 1.5% by weight or from 0.1 to 2% by weight with respect to the total weight of the lubricating composition, a friction modifying additive different from the molybdenum compounds according to the invention.

Advantageously, the lubricating composition according to the invention can comprise at least one antioxidant additive.

Antioxidant additives generally delay the degradation of the lubricating composition. Such degradation is most often expressed by a deposit formation, by the presence of sludge or by an increase in the viscosity of the lubricating composition.

Antioxidant additives generally act as radical inhibitors or hydroperoxide destructor inhibitors. Commonly used antioxidants include phenolic antioxidants, amine antioxidants, antioxidants containing sulfur and phosphorus. Some of the antioxidants, e.g. antioxidants containing sulfur and phosphorus, can generate ash. The phenolic antioxidant additives can be ash free or in the form of neutral or basic metal salts. The antioxidant additives can in particular be chosen from sterically hindered phenols, sterically hindered phenol esters, sterically hindered phenols comprising a thioether bridge, diphenylamines, diphenylamines substituted with at least one $C_1$ to $C_{12}$ alkyl group, N,N'-dialkyl-aryl-diamines and mixtures thereof.

Preferentially, according to the invention, the sterically hindered phenols are chosen from compounds comprising a phenol group for which at least one of the carbon atoms in the vicinity of the carbon atom bearing the alcohol function is substituted by at least one $C_1$ to $C_{10}$ alkyl group, preferentially a $C_1$ to $C_6$ alkyl group, preferentially a $C_4$ alkyl group, preferentially a tert-butyl group.

Amine compounds are another class of antioxidant additives which can be used, optionally in combination with phenolic antioxidant additives. Examples of amine compounds are aromatic amines, e.g. aromatic amines of formula NRaRbRc wherein Ra represents an aliphatic group or an optionally substituted aromatic group, Rb represents an optionally substituted aromatic group, RC represents a hydrogen atom, an alkyl group, An aryl group or a group of the formula RDS(O)zRE wherein Rd represents an alkylene or alkenylene group, Re represents an alkyl group, an alkenyl group or an aryl group and z represents 0, 1 or 2.

Alkyl phenols containing sulfur or the alkali or alkaline-earth metal salts thereof can also be used as antioxidant additives.

Other classes of antioxidant additives are compounds comprising copper, e.g. copper thio- or dithio-phosphate, copper salts and carboxylic acids, dithiocarbamates, sulfonates, phenates, copper acetylacetonates. Copper salts I and II, succinic acid salts or succinic anhydride salts can also be used.

The lubricating compositions according to the invention can further comprise any type of antioxidant known to a person skilled in the art.

Advantageously, the lubricating composition comprises at least one ash free antioxidant additive.

Further advantageously, the lubricating composition according to the invention comprises from 0.1 to 2% by weight with respect to the total weight of the composition, of at least one antioxidant additive.

The lubricating composition according to the invention can further comprise at least one detergent additive.

Detergent additives generally reduce the formation of deposits on the surface of metal parts, by dissolving oxidation and combustion by-products.

The detergent additives which can be used in the lubricating compositions according to the invention are generally known to a person skilled in the art. The detergent additives can be anionic compounds comprising a long lipophilic hydrocarbon chain and a hydrophobic head. The associated cation can be a metal cation of an alkali or alkaline earth metal.

The detergent additives are preferentially chosen from alkali metal or alkaline-earth metal salts of carboxylic acid, sulphonates, salicylates, naphthenates, as well as phenate salts. The alkali metals and alkaline earth metals are preferentially calcium, magnesium, sodium or barium.

Such metal salts generally include the metal in a stoichiometric or in an excess amount, i.e. in a concentration greater than the stoichiometric concentration. Same are then overbased detergents; the excess of metal involving the overbased nature of the detergent additive is generally in the form of an oil-insoluble metal salt, e.g. carbonate, hydroxide, oxalate, acetate, glutamate, preferentially carbonate.

Advantageously, the lubricating composition according to the invention can comprise from 0.5 to 8% or from 2 to 4% by weight of detergent additive overbased with respect to the total weight of the lubricating composition.

Further advantageously, the lubricating composition according to the invention can further comprise an additive which lowers the pour-point.

By slowing down the formation of paraffin crystals, the pour-point lowering additive generally improves the behavior of the lubricating composition under cold conditions, according to the invention.

Examples of additives lowering the pour-point include alkyl polymethacrylates, polyacrylates, polyarylamides, polyalkylphenols, polyalkylnaphthalene, alkyls polystyrenes.

Advantageously, the lubricating composition according to the invention can further comprise a dispersing agent.

The dispersing agents can be chosen from Mannich bases, succinimides and derivatives thereof.

Further advantageously, the lubricating composition according to the invention can comprise from 0.2 to 10% by weight of dispersing agent with respect to the total weight of lubricating composition.

Advantageously, the lubricating composition according to the invention can further comprise at least one other additional polymer improving the viscosity index. As an example of an additional polymer improving the viscosity index, hydrogenated or non-hydrogenated polymeric esters, homopolymers or copolymers of styrene or butadiene, and isoprene, polymethacrylates (PMA), can be cited. Further advantageously, the lubricating composition according to the invention can comprise from 1 to 15% by weight, with respect to the total weight of lubricating composition, of additive improving the viscosity index.

The lubricating composition according to the invention can further comprise at least one thickening agent.

The lubricating composition according to the invention can further comprise an antifoaming agent and a demulsifying agent.

Preferentially, the lubricating composition of the invention further comprises at least one anti-wear agent, in particular an agent containing zinc, in particular ZnDTP.

The present invention further relates to the use of the lubricating composition according to the invention, for reducing frictions of mechanical parts of an engine, at least one of the parts comprising an amorphous carbon coating, preferentially a hydrogenated amorphous carbon coating.

The present invention further relates to the use of a hydrogenated styrene diene polymer in an engine lubricating composition, so as to reduce particle emissions.

The present invention further relates to a method for reducing the emission of particles in an engine, preferentially a gas, gasoline, diesel or hybrid engine, comprising the use of a lubricating composition comprising a base oil and a hydrogenated styrene diene polymer.

The present invention further relates to a method for reducing the emission of particles in an engine, preferentially a gas, gasoline, diesel or hybrid engine, lubricated by a lubricating composition comprising the addition of a hydrogenated styrene diene polymer to said lubricating composition.

The hydrogenated styrene diene polymer, the particles, the base oil and the lubricating composition are as defined above.

The present invention covers all motor vehicles, in particular vehicles comprising a 2-stroke or 4-stroke engine, gasoline, diesel, hybrid or gas engines.

The present invention covers all motor vehicles, preferentially comprising at least one combustion engine, in particular heavy vehicles or light vehicles.

The present invention will now be described with the help of non-limiting examples.

EXAMPLE 1: LUBRICATING COMPOSITIONS

The following lubricating compositions were prepared according to Table 2 below.

TABLE 2

| | Composition 1 (according to the invention) (in % with respect to the total weight of the composition) | Composition 2 (according to the invention) (in % with respect to the total weight of the composition) | Composition 3 (comparative) (in % with respect to the total weight of the composition) |
|---|---|---|---|
| Additives package | 15.6 | 15.6 | 15.6 |
| Base oil | 83.6 | 83.7 | 84.4 |
| Star-shaped hydrogenated styrene/isoprene copolymer | 0.8 | 0.7 | — |

The characteristics of the lubricating compositions are collated in Table 3 below:

TABLE 3

| | Composition 1 (according to the invention) | Composition 2 (according to the invention) | Composition 3 (comparative) |
|---|---|---|---|
| KV 40° C. ASTM D445-97 ($mm^2/s$) | 28.55 | 29.1 | 32.58 |
| KV 100° C. ASTM D445-97 ($mm^2/s$) | 5.894 | 6.038 | 6.407 |

TABLE 3-continued

| | Composition 1 (according to the invention) | Composition 2 (according to the invention) | Composition 3 (comparative) |
|---|---|---|---|
| HTHS 150° C. CEC L-036-90 or ASTM D4683 | 2.1 | 2.1 | 2.2 |
| CCS −35° C. ASTM D 5293 | 4177 | 3941 | 4176 |
| Noack ASTM D5800 or CEC L-040-93 | 15% | 12% | 7.8% |

EXAMPLE 2: MEASUREMENT OF THE NUMBER OF EMITTED PARTICLES

The compositions of example 1 were subjected to the WLTC test and the quantity of particles per kilometer traveled having a size greater than or equal to 23 nm emitted at the end of each cycle was measured.

The engine tests were carried out on turbocharged straight-four engines. The tests were carried out at the same starting temperature of the engine. All other test bench conditions were kept constant as well. Sampling for the exhaust gas measurements was carried out from raw exhaust gases ahead from the exhaust system but after the treatment systems. Thus, the effects observed are indeed due solely to the use of the lubricating composition and thus to the use of the hydrogenated styrene-diene polymer and not to any other criterion such as the presence of a driver, the weight of the vehicle, the temperature, the relative humidity, etc.

The particle size distribution was measured in parallel by a Cambustion differential mobility spectrometer (DMS500). Same uses a high voltage discharge for charging every particle proportionally to the surface area thereof. The charged particles are introduced into a classification section with a strong radial electric field. Such field causes particles to drift through a flow inside a column, toward the electrometer detectors. The particles are detected at different distances in the column, depending on the aerodynamic resistance/charge ratio thereof. The outputs of the 22 electrometers are processed in real-time at 10 Hz, so as to provide spectral data and other measurements.

TABLE 4

| | Composition 1 (according to the invention) (number of particles with size greater than 23 nm) | Composition 2 (according to the invention) (number of particles with size greater than 23 nm) | Composition 3 (comparative) (number of particles with size greater than 23 nm) |
|---|---|---|---|
| Urban cycle | $7 \times 10^8$ | $5.82 \times 10^8$ | $1.34 \times 10^9$ |
| Peri-urban cycle | $5.22 \times 10^8$ | $4.88 \times 10^8$ | $6.30 \times 10^8$ |
| Road cycle | $3.52 \times 10^8$ | $3.25.10^8$ | $5.90 \times 10^8$ |
| Freeway cycle | $3.29 \times 10^8$ | $2.30 \times 10^8$ | $2.77 \times 10^8$ |
| WLTC whole cycle (average weighted by the distance of every phase) | $4.2539 \times 10^8$ | $3.5934 \times 10^8$ | $5.8817 \times 10^8$ |

The results show that the addition of a hydrogenated styrene isoprene polymer in a lubricating composition reduces the quantity—released from the exhaust—of particles with a size greater than or equal to 23 nm.

The invention claimed is:

1. A method of reducing particle emissions in a motor vehicle engine comprising at least one step of bringing into contact the engine with a lubricating composition, the lubricating composition comprising a base oil and a star-shaped hydrogenated styrene diene polymer, wherein the diene polymer is a hydrogenated isoprene unit.

2. The method according to claim 1, wherein the content of hydrogenated diene units is from 50 to 98%, with respect to the weight of the polymer.

3. The method according to claim 1, wherein the content of styrene units is from 2 to 50%, with respect to the weight of polymer.

4. The method according to claim 1, wherein the hydrogenated styrene diene polymer is used in an amount of 0.1 to 15% by weight with respect to the total weight of the lubricating composition.

5. The method according to claim 1, wherein the particles have a size greater than or equal to 23 nm.

6. The method according to claim 1 wherein the reduction of particulate emissions relates to the urban, peri-urban and road-type cycles, said cycles being defined by the Worldwide Harmonized Light vehicles Test Procedures and/or related to the whole Worldwide Harmonized Light vehicles Test Procedures.

7. A method for reducing particle emission in a motor vehicle engine lubricated with a lubricating composition comprising the addition of a star-shaped hydrogenated styrene diene polymer to said lubricating composition, wherein the diene polymer is a hydrogenated isoprene unit.

8. The method according to claim 7, wherein the particles have a size greater than or equal to 23 nm.

9. The method according to claim 7, wherein the reduction of particulate emissions relates to the urban, peri-urban and road-type cycles, said cycles being defined by the Worldwide Harmonized Light vehicles Test Procedures and/or related to the whole Worldwide Harmonized Light vehicles Test Procedures.

* * * * *